US007878775B2

(12) United States Patent
Duppert et al.

(10) Patent No.: US 7,878,775 B2
(45) Date of Patent: Feb. 1, 2011

(54) SCROLL COMPRESSOR WITH HOUSING SHELL LOCATION

(75) Inventors: Ronald J. Duppert, Fayetteville, NY (US); Wayne P. Beagle, Chittenango, NY (US); James W. Bush, Skaneateles, NY (US)

(73) Assignee: Bitzer Kuhlmaschinenbau GmbH (DE)

( * ) Notice: Subject to any disclaimer, the term of this patent is extended or adjusted under 35 U.S.C. 154(b) by 431 days.

(21) Appl. No.: 12/015,651

(22) Filed: Jan. 17, 2008

(65) Prior Publication Data

US 2009/0185930 A1 Jul. 23, 2009

(51) Int. Cl.
*F01C 1/02* (2006.01)
*F03C 2/00* (2006.01)
*F03C 4/00* (2006.01)

(52) U.S. Cl. ..... 418/55.1; 418/1; 418/55.5; 418/57

(58) Field of Classification Search ..... 418/1, 418/55.1–55.6, 57, 270
See application file for complete search history.

(56) References Cited

U.S. PATENT DOCUMENTS 4,655,696 A 4/1987 Utter
4,696,630 A 9/1987 Sakata et al.
4,927,339 A 5/1990 Riffe et al.
5,090,878 A 2/1992 Haller
5,320,506 A 6/1994 Fogt
5,427,511 A 6/1995 Caillat et al.
5,505,595 A * 4/1996 Fukui ..... 418/55.1
5,582,312 A 12/1996 Niles et al.
6,227,830 B1 * 5/2001 Fields et al. ..... 418/55.1
6,398,530 B1 6/2002 Hasemann
6,439,867 B1 8/2002 Clendenin
6,454,538 B1 * 9/2002 Witham et al. ..... 418/55.1
6,488,489 B2 12/2002 Williams et al.
6,682,327 B2 * 1/2004 Milliff et al. ..... 418/55.1
6,761,541 B1 7/2004 Clendenin
6,814,551 B2 11/2004 Kammhoff et al.
6,960,070 B2 11/2005 Kammhoff et al.
7,112,046 B2 9/2006 Kammhoff et al.

FOREIGN PATENT DOCUMENTS

EP 0 508 293 A1 10/1992

(Continued)

OTHER PUBLICATIONS

U.S. Appl. No. 12/015,571, filed Jan. 17, 2008, Duppert et al.

(Continued)

*Primary Examiner*—Theresa Trieu
(74) *Attorney, Agent, or Firm*—Reinhart Boerner Van Deuren P.C.

(57) ABSTRACT

A scroll compressor includes a feature for location of a housing shell section off of one of the scroll compressor bodies. According to this aspect, a scroll compressor comprises a housing including a shell section; scroll compressor bodies having respective bases and respective scroll ribs that project from the respective bases and which mutually engage about an axis for compressing fluid; and a drive unit operative to facilitate relative movement between the scroll compressor bodies. The shell section is located axially relative to a remainder of the housing off of one of the scroll compressor bodies.

26 Claims, 6 Drawing Sheets

FOREIGN PATENT DOCUMENTS

| | | | |
|---|---|---|---|
| EP | 0 520 517 | A1 | 12/1992 |
| JP | 11050981 | | 2/1999 |
| WO | WO 2007/050292 | A1 | 5/2007 |

OTHER PUBLICATIONS

U.S. Appl. No. 12/015,557, filed Jan. 17, 2008, Bush.
U.S. Appl. No. 12/015,689, filed Jan. 17, 2008, Beagle et al.
U.S. Appl. No. 12/015,589, filed Jan. 17, 2008, Bush et al.
U.S. Appl. No. 12/015,592, filed Jan. 17, 2008, Bush et al.
U.S. Appl. No. 12/015,596, filed Jan. 17, 2008, Beagle et al.
U.S. Appl. No. 12/015,599, filed Jan. 17, 2008, Bush.
U.S. Appl. No. 12/015,643, filed Jan. 17, 2008, Duppert et al.
U.S. Appl. No. 12/015,660, filed Jan. 17, 2008, Beagle et al.

* cited by examiner

SCROLL COMPRESSOR WITH HOUSING SHELL LOCATION

FIELD OF THE INVENTION

The present invention generally relates to scroll compressors for compressing refrigerant and more particularly relates to the location of housing shell sections of such scroll compressors.

BACKGROUND OF THE INVENTION

A scroll compressor is a certain type of compressor that is used to compress refrigerant for such applications as refrigeration, air conditioning, industrial cooling and freezer applications, and/or other applications where compressed fluid may be used. Such prior scroll compressors are known, for example, as exemplified in U.S. Pat. No. 6,398,530 to Hasemann; U.S. Pat. No. 6,814,551, to Kammhoff et al.; U.S. Pat. No. 6,960,070 to Kammhoff et al.; and U.S. Pat. No. 7,112,046 to Kammhoff et al., all of which are assigned to a Bitzer entity closely related to the present assignee. As the present disclosure pertains to improvements that can be implemented in these or other scroll compressor designs, the entire disclosures of U.S. Pat. Nos. 6,398,530; 7,112,046; 6,814,551; and 6,960,070 are hereby incorporated by reference in their entireties.

As is exemplified by these patents, scroll compressors conventionally include an outer housing having a scroll compressor contained therein. A scroll compressor includes first and second scroll compressor members. A first compressor member is typically arranged stationary and fixed in the outer housing. A second scroll compressor member is moveable relative to the first scroll compressor member in order to compress refrigerant between respective scroll ribs which rise above the respective bases and engage in one another. Conventionally the moveable scroll compressor member is driven about an orbital path about a central axis for the purposes of compressing refrigerant. An appropriate drive unit, typically an electric motor, is provided usually within the same housing to drive the movable scroll member.

The present invention is directed toward improvements in the location of housing sections in such scroll compressors.

BRIEF SUMMARY OF THE INVENTION

In one aspect, the invention provides a scroll compressor with axial location of a housing section off of one of the scroll compressor bodies. Such location may be by engagement and/or by providing a stop limit that limits the maximum extent to which a housing section may slide upon another housing section. According to this aspect, a scroll compressor comprises a housing including a shell section; scroll compressor bodies having respective bases and respective scroll ribs that project from the respective bases and which mutually engage about an axis for compressing fluid; and a drive unit operative to facilitate relative movement between the scroll compressor bodies. The shell section is located axially relative to a remainder of the housing off of one of the scroll compressor bodies.

One feature according to the above aspect is providing a seal between said one of the scroll compressor bodies and the shell section, the seal be located axially between the drive unit and the said axial location. Another different feature according to the above aspect is by thinning the metal along the inner periphery of the shell section so as to facilitate abutment with the scroll compressor body. Such features can help to minimize the diameter (and thereby weight and other issues) of the scroll compressor and/or provide for other benefits.

In yet another aspect, the invention provides a method of making a scroll compressor in which axial movement of one of the housing shell sections is limited by one of the scroll compressor bodies. The method includes: assembling scroll compressor bodies having respective bases and respective scroll ribs that project from the respective bases and which mutually engage about an axis for compressing fluid; assembling a housing shell section over the scroll compressor bodies; limiting axial movement of the housing shell section with one of the scroll compressor bodies; and securing the housing section to a remainder of a housing.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

Figure 1:
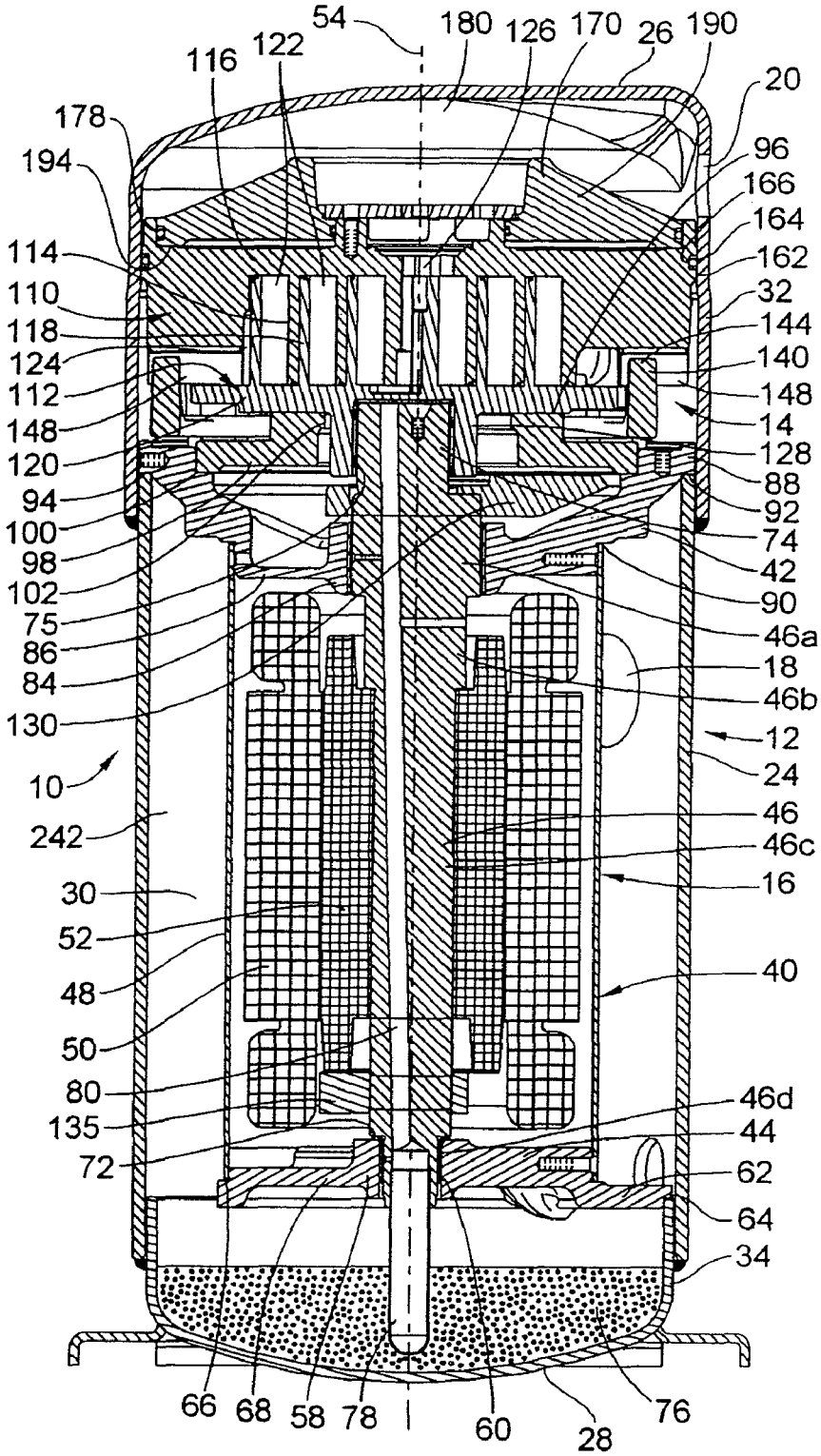
FIG. 1 is a cross section of a scroll compressor assembly in accordance with an embodiment of the present invention.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

An embodiment of the present invention is illustrated in the figures as a scroll compressor assembly 10 generally including an outer housing 12 in which a scroll compressor 14 can be driven by a drive unit 16. The scroll compressor assembly may be arranged in a refrigerant circuit for refrigeration, industrial cooling, freezing, air conditioning or other appropriate applications where compressed fluid is desired. Appropriate connection ports provide for connection to a refrigeration circuit and include a refrigerant inlet port 18 and a refrigerant outlet port 20 extending through the outer housing 12. The scroll compressor assembly 10 is operable through operation of the drive unit 16 to operate the scroll compressor 14 and thereby compress an appropriate refrigerant or other fluid that enters the refrigerant inlet port 18 and exits the refrigerant outlet port 20 in a compressed high pressure state.

The outer housing 12 may take many forms. In the preferred embodiment, the outer housing includes multiple shell sections and preferably three shell sections to include a central cylindrical housing section 24, a top end housing section 26 and a bottom end housing section 28. Preferably, the housing sections 24, 26, 28 are formed of appropriate sheet steel and welded together to make a permanent outer housing 12 enclosure. However, if disassembly of the housing is desired, other housing provisions can be made that can include metal castings or machined components.

The central housing section 24 is preferably cylindrical and telescopically interfits with the top and bottom end housing sections 26, 28. This forms an enclosed chamber 30 for housing the scroll compressor 14 and drive unit 16. Each of the top and bottom end housing sections 26, 28 are generally dome shaped and include respective cylindrical side wall regions 32, 34 to mate with the center section 24 and provide for closing off the top and bottom ends of the outer housing 12. As can be seen in FIG. 1, the top side wall region 32 telescopically overlaps the central housing section 24 and is exteriorly welded along a circular welded region to the top end of the central housing section 24. Similarly the bottom side wall region 34 of the bottom end housing section 28 telescopically interfits with the central housing section 24 (but is shown as being installed into the interior rather than the exterior of the central housing section 24) and is exteriorly welded by a circular weld region.

The drive unit 16 may preferably take the form of an electrical motor assembly 40, which is supported by upper and lower bearing members 42, 44. The motor assembly 40 operably rotates and drives a shaft 46. The electrical motor assembly 40 generally includes an outer annular motor housing 48, a stator 50 comprising electrical coils and a rotor 52 that is coupled to the drive shaft 46 for rotation together. Energizing the stator 50 is operative to rotatably drive the rotor 52 and thereby rotate the drive shaft 46 about a central axis 54.

Figure 4:
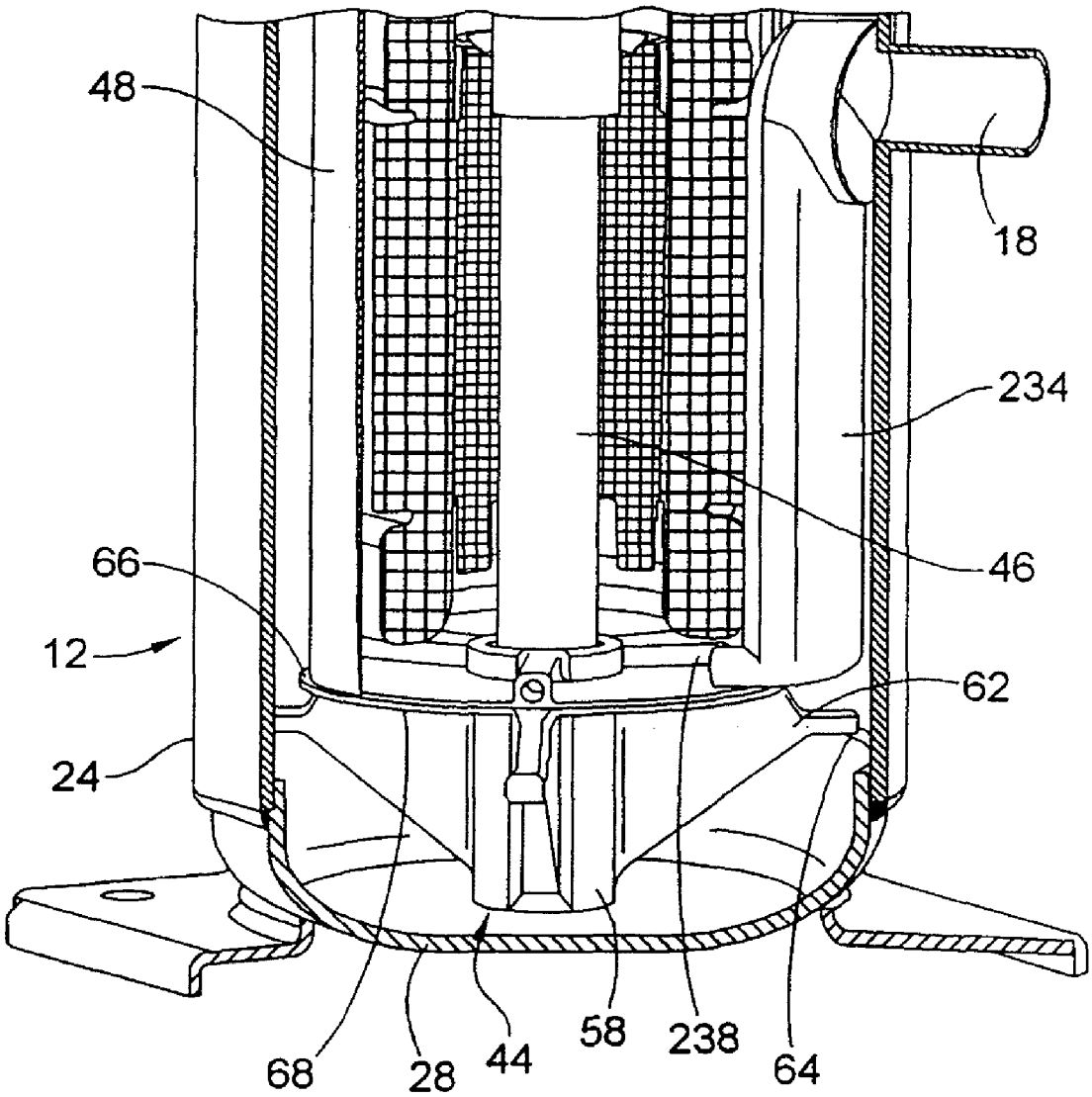
FIG. 4 is a partial cross section and cut-away view of a lower portion of the embodiment of FIG. 1.

With reference to FIGS. 1 and 4, the lower bearing member 44 includes a central generally cylindrical hub 58 that includes a central bushing and opening to provide a cylindrical bearing 60 to which the drive shaft 46 is journaled for rotational support. A plurality of arms 62 and typically at least three arms project radially outward from the bearing central hub 58 preferably at equally spaced angular intervals. These support arms 62 engage and are seated on a circular seating surface 64 provided by the terminating circular edge of the bottom side wall region 34 of the bottom outer housing section 28. As such, the bottom housing section 28 can serve to locate, support and seat the lower bearing member 44 and thereby serves as a base upon which the internal components of the scroll compressor assembly can be supported.

The lower bearing member 44 in turn supports the cylindrical motor housing 48 by virtue of a circular seat 66 formed on a plate-like ledge region 68 of the lower bearing member 44 that projects outward along the top of the central hub 58. The support arms 62 also preferably are closely toleranced relative to the inner diameter of the central housing section. The arms 62 may engage with the inner diameter surface of the central housing section 24 to centrally locate the lower bearing member 44 and thereby maintain position of the central axis 54. This can be by way of an interference and press-fit support arrangement between the lower bearing member 44 and the outer housing 12 (See e.g. FIG. 4). Alternatively according to a more preferred configuration, as shown in FIG. 1, the lower bearing engages with the lower housing section 28 which is in turn attached to center section 24. Likewise, the outer motor housing 48 may be supported with an interference and press-fit along the stepped seat 66 of the lower bearing member 44. As shown, screws may be used to securely fasten the motor housing to the lower bearing member 44.

The drive shaft 46 is formed with a plurality of progressively smaller diameter sections 46*a*-46*d* which are aligned concentric with the central axis 54. The smallest diameter section 46*d* is journaled for rotation within the lower bearing member 44 with the next smallest section 46*c* providing a step 72 for axial support of the drive shaft 46 upon the lower bearing member 44. The largest section 46*a* is journaled for rotation within the upper bearing member 42.

The drive shaft 46 further includes an offset eccentric drive section 74 that has a cylindrical drive surface 75 about an offset axis that is offset relative to the central axis 54. This offset drive section 74 is journaled within a cavity of the movable scroll member of the scroll compressor 14 to drive the movable member of the scroll compressor about an orbital path when the drive shaft 46 is spun about the central axis 54. To provide for lubrication of all of these bearing surfaces, the outer housing 12 provides an oil lubricant sump 76 at the bottom end in which suitable oil lubricant is provided. The drive shaft 46 has an oil lubricant pipe and impeller 78 that acts as an oil pump when the drive shaft is spun and thereby pumps oil out of the lubricant sump 76 into an internal lubricant passageway 80 defined within the drive shaft 46. During rotation of the drive shaft 46, centrifugal force acts to drive lubricant oil up through the lubricant passageway 80 against the action of gravity. The lubricant passageway 80 includes various radial passages as shown to feed oil through centrifugal force to appropriate bearing surfaces and thereby lubricate sliding surfaces as may be desired.

The upper bearing member 42 includes a central bearing hub 84 into which the largest section 46*a* of the drive shaft 46 is journaled for rotation. Extending outward from the bearing hub 84 is a support web 86 that merges into an outer peripheral support rim 88. Provided along the support web 86 is an annular stepped seating surface 90 which may have an interference and press-fit with the top end of the cylindrical motor housing 48 to thereby provide for axial and radial location. The motor housing 48 may also be fastened with screws to the upper bearing member 42. The outer peripheral support rim 88 also may include an outer annular stepped seating surface 92 which may have an interference and press-fit with the outer housing 12. For example, the outer peripheral rim 88 can engage the seating surface 92 axially, that is it engages on a lateral plane perpendicular to axis 54 and not through a diameter. To provide for centering there is provided a diametric fit just below the surface 92 between the central housing section 24 and the support rim 88. Specifically, between the telescoped central and top-end housing sections 24, 26 is defined in internal circular step 94, which is located axially and radially with the outer annular step 92 of the upper bearing member 42.

The upper bearing member 42 also provides axial thrust support to the movable scroll member through a bearing support via an axial thrust surface 96. While this may be integrally provided by a single unitary component, it is shown as being provided by a separate collar member 98 that is interfit with the upper portion of the upper bearing member 42 along stepped annular interface 100. The collar member 98 defines a central opening 102 that is a size large enough to provide for receipt of the eccentric offset drive section 74 and allow for orbital eccentric movement thereof that is provided within a receiving portion of the movable scroll compressor member 112.

Turning in greater detail to the scroll compressor 14, the scroll compressor body is provided by first and second scroll compressor bodies which preferably include a stationary fixed scroll compressor body 110 and a movable scroll compressor body 112. The moveable scroll compressor body 112 is arranged for orbital movement relative to the fixed scroll compressor body 110 for the purpose of compressing refrigerant. The fixed scroll compressor body includes a first rib 114 projecting axially from a plate-like base 116 and is designed in the form of a spiral. Similarly, the second movable scroll compressor body 112 includes a second scroll rib 118 projecting axially from a plate-like base 120 and is in the design form of a similar spiral. The scroll ribs 114, 118 engage in one another and abut sealingly on the respective base surfaces 120, 116 of the respectively other compressor body 112, 110. As a result, multiple compression chambers 122 are formed between the scroll ribs 114, 118 and the bases 120, 116 of the compressor bodies 112, 110. Within the chambers 122, progressive compression of refrigerant takes place. Refrigerant flows with an initial low pressure via an intake area 124 surrounding the scroll ribs 114, 118 in the outer radial region (see e.g. FIGS. 2-3). Following the progressive compression in the chambers 122 (as the chambers progressively are defined radially inward), the refrigerant exits via a compression outlet 126 which is defined centrally within the base 116 of the fixed scroll compressor body 110. Refrigerant that has been compressed to a high pressure can exit the chambers 122 via the compression outlet 126 during operation of the scroll compressor.

The movable scroll compressor body 112 engages the eccentric offset drive section 74 of the drive shaft 46. More specifically, the receiving portion of the movable scroll compressor body 112 includes a cylindrical bushing drive hub 128 which slideably receives the eccentric offset drive section 74 with a slideable bearing surface provided therein. In detail, the eccentric offset drive section 74 engages the cylindrical drive hub 128 in order to move the moveable scroll compressor body 112 about an orbital path about the central axis 54 during rotation of the drive shaft 46 about the central axis 54. Considering that this offset relationship causes a weight imbalance relative to the central axis 54, the assembly preferably includes a counter weight 130 that is mounted at a fixed angular orientation to the drive shaft 46. The counter weight 130 acts to offset the weight imbalance caused by the eccentric offset drive section 74 and the movable scroll compressor body 112 that is driven about an orbital path (e.g. among other things, the scroll rib is not equally balanced). The counter weight 130 includes an attachment collar 132 and an offset weight region 134 (see counter weight shown best in FIG. 2) that provides for the counter weight effect and thereby balancing of the overall weight of the rotating components about the central axis 54 in cooperation with a lower counterweight 135 for balancing purposes. This provides for reduced vibration and noise of the overall assembly by internally balancing or cancelling out inertial forces.

Figure 2:
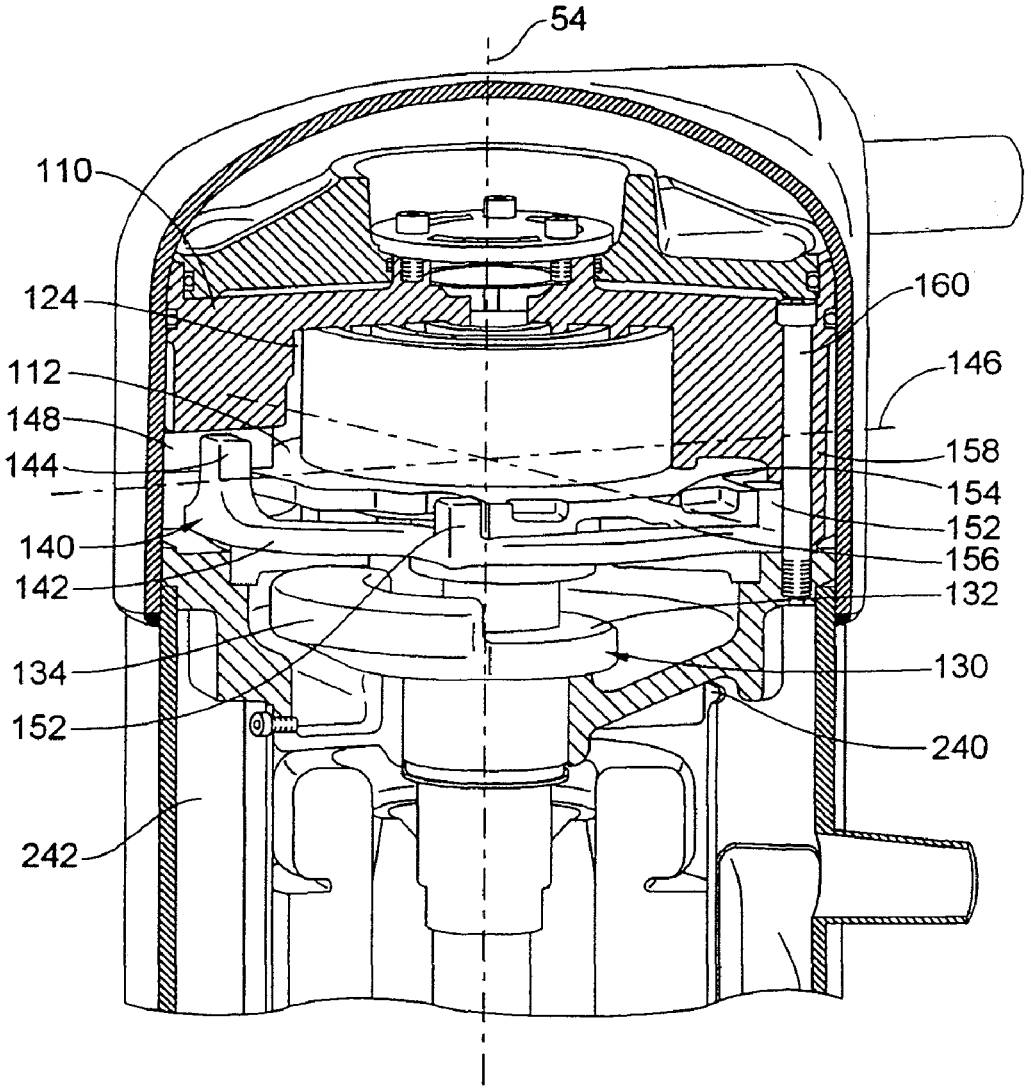
FIG. 2 is a partial cross section and cut-away view of an isometric drawing of an upper portion of the scroll compressor embodiment shown in FIG. 1.
Figure 3:
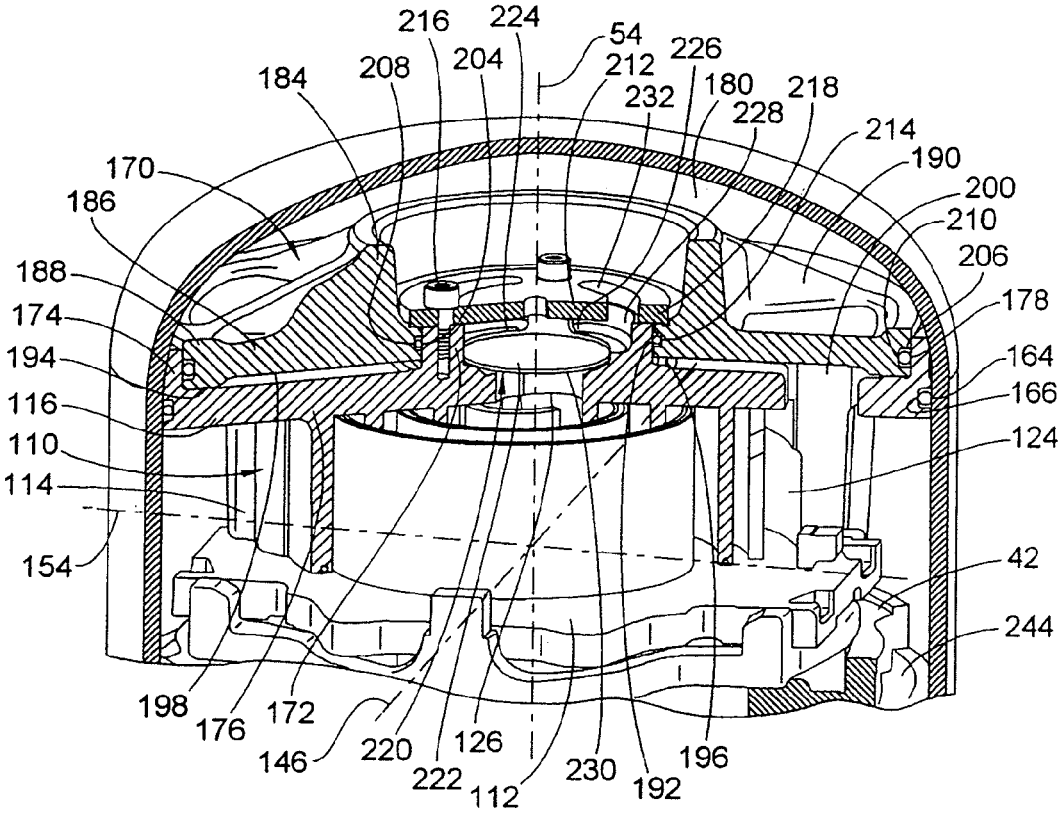
FIG. 3 is a similar view to FIG. 2 but enlarged and taken about a different angle and section in order to show other structural features.

With reference to FIGS. 1-3, and particularly FIG. 2, the guiding movement of the scroll compressor can be seen. To guide the orbital movement of the movable scroll compressor body 112 relative to the fixed scroll compressor body 110, an appropriate key coupling 140 may be provided. Keyed couplings are often referred to in the scroll compressor art as an "Oldham Coupling." In this embodiment, the key coupling 140 includes an outer ring body 142 and includes two first keys 144 that are linearly spaced along a first lateral axis 146 and that slide closely and linearly within two respective keyway tracks 148 that are linearly spaced and aligned along the first axis 146 as well. The key way tracks 148 are defined by the stationary fixed scroll compressor body 110 such that the linear movement of the key coupling 140 along the first lateral axis 146 is a linear movement relative to the outer housing 12 and perpendicular to the central axis 54. The keys can comprise slots, grooves or, as shown, projections which project from the ring body 142 of the key coupling 140. This control of movement over the first lateral axis 146 guides part of the overall orbital path of the moveable scroll compressor body 112.

Additionally, the key coupling includes four second keys 152 in which opposed pairs of the second keys 152 are linearly aligned substantially parallel relative to a second traverse lateral axis 154 that is perpendicular to the first lateral axis 146. There are two sets of the second keys 152 that act cooperatively to receive projecting sliding guide portions 156 that project from the base 120 on opposite sides of the movable scroll compressor body 112. The guide portions 156 linearly engage and are guided for linear movement along the second traverse lateral axis by virtue of sliding linear guiding movement of the guide portions 156 along sets of the second keys 152.

By virtue of the key coupling 140, the moveable scroll compressor body 112 has movement restrained relative to the fixed scroll compressor body 110 along the first lateral axis 146 and second traverse lateral axis 154. This results in the prevention of any relative rotation of the moveable scroll body as it allows only translational motion. More particularly, the fixed scroll compressor body 110 limits motion of the key coupling 140 to linear movement along the first lateral axis 146; and in turn, the key coupling 140 when moving along the first lateral axis 146 carries the moveable scroll 112 along the first lateral axis 146 therewith. Additionally, the movable scroll compressor body can independently move relative to the key coupling 140 along the second traverse lateral axis 154 by virtue of relative sliding movement afforded by the guide portions 156 which are received and slide between the second keys 152. By allowing for simultaneous movement in two mutually perpendicular axes 146, 154, the eccentric motion that is afforded by the eccentric offset drive section 74 of the drive shaft 46 upon the cylindrical drive hub 128 of the movable scroll compressor body 112 is translated into an orbital path movement of the movable scroll compressor body 112 relative to the fixed scroll compressor body 110.

Referring in greater detail to the fixed scroll compressor body 110, this body 110 is fixed to the upper bearing member 42 by an extension extending axially and vertically therebetween and around the outside of the moveable scroll compressor body 112. In the illustrated embodiment, the fixed scroll compressor body 110 includes a plurality of axially projecting legs 158 (see FIG. 2) projecting on the same side as the scroll rib from the base 116. These legs 158 engage and are seated against the top side of the upper bearing member 42. Preferably, bolts 160 (FIG. 2) are provided to fasten the fixed scroll compressor body 110 to the upper bearing member 42. The bolts 160 extend axially through the legs 158 of the fixed scroll compressor body and are fastened and screwed into corresponding threaded openings in the upper bearing member 42. For further support and fixation of the fixed scroll compressor body 110, the outer periphery of the fixed scroll compressor body includes a cylindrical surface 162 that is closely received against the inner cylindrical surface of the outer housing 10 and more particularly the top end housing section 26. A clearance gap between surface 162 and side wall 32 serves to permit assembly of upper housing 26 over the compressor assembly and subsequently to contain the o-ring seal 164. An O-ring seal 164 seals the region between the cylindrical locating surface 162 and the outer housing 112 to prevent a leak path from compressed high pressure fluid to the uncompressed section/sump region inside of the outer housing 12. The seal 164 can be retained in a radially outward facing annular groove 166.

With reference to FIGS. 1-3 and particularly FIG. 3, the upper side (e.g. the side opposite the scroll rib) of the fixed scroll 110 supports a floatable baffle member 170. To accommodate the same, the upper side of the fixed scroll compressor body 110 includes an annular and more specifically cylindrical inner hub region 172 and an outwardly spaced peripheral rim 174 which are connected by radially extending disc region 176 of the base 116. Between the hub 172 and the rim 174 is provided an annular piston-like chamber 178 into which the baffle member 170 is received. With this arrangement, the combination of the baffle member 170 and the fixed scroll compressor body 110 serve to separate a high pressure chamber 180 from lower pressure regions within the housing 10. While the baffle member 170 is shown as engaging and constrained radially within the outer peripheral rim 174 of the fixed scroll compressor body 110, the baffle member 170 could alternatively be cylindrically located against the inner surface of the outer housing 12 directly.

As shown in the embodiment, and with particular reference to FIG. 3, the baffle member 170 includes an inner hub region 184, a disc region 186 and an outer peripheral rim region 188. To provide strengthening, a plurality of radially extending ribs 190 extending along the top side of the disc region 186 between the hub region 184 and the peripheral rim region 188 may be integrally provided and are preferably equally angularly spaced relative to the central axis 54. The baffle member 170 in addition to tending to separate the high pressure chamber 180 from the remainder of the outer housing 12 also serves to transfer pressure loads generated by high pressure chamber 180 away from the inner region of the fixed scroll compressor body 110 and toward the outer peripheral region of the fixed scroll compressor body 110. At the outer peripheral region, pressure loads can be transferred to and carried more directly by the outer housing 12 and therefore avoid or at least minimize stressing components and substantially avoid deformation or deflection in working components such as the scroll bodies. Preferably, the baffle member 170 is floatable relative to the fixed scroll compressor body 110 along the inner peripheral region. This can be accomplished, for example, as shown in the illustrated embodiment by a sliding cylindrical interface 192 between mutually cylindrical sliding surfaces of the fixed scroll compressor body and the baffle member along the respective hub regions thereof. As compressed high pressure refrigerant in the high pressure chamber 180 acts upon the baffle member 170, substantially no load may be transferred along the inner region, other than as may be due to frictional engagement. Instead, an axial contact interface ring 194 is provided at the radial outer periphery where the respective rim regions are located for the fixed scroll compressor body 110 and the baffle member 170. Preferably, an annular axial gap 196 is provided between the innermost diameter of the baffle member 170 and the upper side of the fixed scroll compressor body 110. The annular axial gap 196 is defined between the radially innermost portion of the baffle member and the scroll member and is adapted to decrease in size in response to a pressure load caused by high pressure refrigerant compressed within the high pressure chamber 180. The gap 196 is allowed to expand to its relaxed size upon relief of the pressure and load.

To facilitate load transfer most effectively, an annular intermediate or lower pressure chamber 198 is defined between the baffle member 170 and the fixed scroll compressor body 110. This intermediate or lower pressure chamber can be subject to either the lower sump pressure as shown, or can be subject to an intermediate pressure (e.g. through a fluid communication passage defined through the fixed scroll compressor body to connect one of the individual compression chambers 122 to the chamber 198). Load carrying characteristics can therefore be configured based on the lower or intermediate pressure that is selected for best stress/deflection management. In either event, the pressure contained in the intermediate or low pressure chamber 198 during operation is substantially less than the high pressure chamber 180 thereby causing a pressure differential and load to develop across the baffle member 170.

To prevent leakage and to better facilitate load transfer, inner and outer seals 204, 206 may be provided, both of which may be resilient, elastomeric O-ring seal members. The inner seal 204 is preferably a radial seal and disposed in a radially inwardly facing inner groove 208 defined along the inner diameter of the baffle member 170. Similarly the outer seal 206 can be disposed in a radially outwardly facing outer groove 210 defined along the outer diameter of the baffle member 170 in the peripheral rim region 188. While a radial seal is shown at the outer region, alternatively or in addition an axial seal may be provided along the axial contact interface ring 194.

While the baffle member 170 could be a stamped steel component, preferably and as illustrated, the baffle member 170 comprises a cast and/or machined member (and may be aluminum) to provide for the expanded ability to have several structural features as discussed above. By virtue of making the baffle member in this manner, heavy stamping of such baffles can be avoided.

Additionally, the baffle member 170 can be retained to the fixed scroll compressor body 110. Specifically, as can be seen in the figures, a radially inward projecting annular flange 214 of the inner hub region 184 of the baffle member 170 is trapped axially between the stop plate 212 and the fixed scroll compressor body 110. The stop plate 212 is mounted with bolts 216 to a fixed scroll compressor body 210. The stop plate 212 includes an outer ledge 218 that projects radially over the inner hub 172 of the fixed scroll compressor body 110. The stop plate ledge 218 serves as a stop and retainer for the baffle member 170. In this manner, the stop plate 212 serves to retain the baffle member 170 to the fixed scroll compressor body 110 such that the baffle member 170 is carried thereby.

As shown, the stop plate 212 can be part of a check valve 220. The check valve includes a moveable valve plate element 222 contained within a chamber defined in the outlet area of the fixed scroll compressor body within the inner hub 172. The stop plate 212 thus closes off a check valve chamber 224 in which the moveable valve plate element 222 is located. Within the check valve chamber there is provided a cylindrical guide wall surface 226 that guides the movement of the check valve 220 along the central axis 54. Recesses 228 are provided in the upper section of the guide wall 226 to allow for compressed refrigerant to pass through the check valve when the moveable valve plate element 222 is lifted off of the valve seat 230. Openings 232 are provided in the stop plate 212 to facilitate passage of compressed gas from the scroll compressor into the high pressure chamber 180. The check valve is operable to allow for one way directional flow such that when the scroll compressor is operating, compressed refrigerant is allowed to leave the scroll compressor bodies through the compression outlet 126 by virtue of the valve plate element 222 being driven off of its valve seat 230. However, once the drive unit shuts down and the scroll compressor is no longer operating, high pressure contained within the high pressure chamber 180 forces the movable valve plate element 222 back upon the valve seat 230. This closes off check valve 220 and thereby prevents backflow of compressed refrigerant back through the scroll compressor.

During operation, the scroll compressor assembly 10 is operable to receive low pressure refrigerant at the housing inlet port 18 and compress the refrigerant for delivery to the high pressure chamber 180 where it can be output through the housing outlet port 20. As is shown, in FIG. 4, an internal conduit 234 can be connected internally of the housing 12 to guide the lower pressure refrigerant from the inlet port 18 into the motor housing via a motor housing inlet 238. This allows the low pressure refrigerant to flow across the motor and thereby cool and carry heat away from the motor which can be caused by operation of the motor. Low pressure refrigerant can then pass longitudinally through the motor housing and around through void spaces therein toward the top end where it can exit through a plurality of motor housing outlets 240 (see FIG. 2) that are equally angularly spaced about the central axis 54. The motor housing outlets 240 may be defined either in the motor housing 48, the upper bearing member 42 or by a combination of the motor housing and upper bearing member (e.g. by gaps formed therebetween as shown in FIG. 2). Upon exiting the motor housing outlet 240, the low pressure refrigerant enters an annular chamber 242 formed between the motor housing and the outer housing. From there, the low pressure refrigerant can pass through the upper bearing member through a pair of opposed outer peripheral through ports 244 that are defined by recesses on opposed sides of the upper bearing member 42 to create gaps between the bearing member 42 and housing 12 as shown in FIG. 3 (or alternatively holes in bearing member 42). The through ports 244 may be angularly spaced relative to the motor housing outlets 240. Upon passing through the upper bearing member 42, the low pressure refrigerant finally enters the intake area 124 of the scroll compressor bodies 110, 112. From the intake area 124, the lower pressure refrigerant finally enters the scroll ribs 114, 118 on opposite sides (one intake on each side of the fixed scroll compressor body) and is progressively compressed through chambers 122 to where it reaches it maximum compressed state at the compression outlet 126 where it subsequently passes through the check valve 220 and into the high pressure chamber 180. From there, high pressure compressed refrigerant may then pass from the scroll compressor assembly 10 through the refrigerant housing outlet port 20.

In accordance with the present invention, the first embodiment illustrated in FIGS. 1-4 provides for a stop limit that limits how far the upper housing section 26 can slide down upon the central cylindrical housing section 24. This stop limit may either be the top axial abutment edge provided by the rim 174 of the fixed scroll compressor body 110 or, alternatively, by the outer periphery of the fixed scroll compressor body 110 (e.g. that interacts with the slight inner surface cant of the cylindrical wall of the upper housing section). In either event, the fixed scroll compressor body 110 in this first embodiment serves to provide a stop limit that limits the extent to which the upper shell housing section 26 can be slid axially upon the central cylindrical housing section 24 and thereby limit where the circumferential weld is provided when these two housing sections telescopically are interfitted. This can also serve to define a predetermined volume chamber for the high pressure chamber 180 that is formed between the fixed scroll compressor body and the upper shell section.

Figure 5:
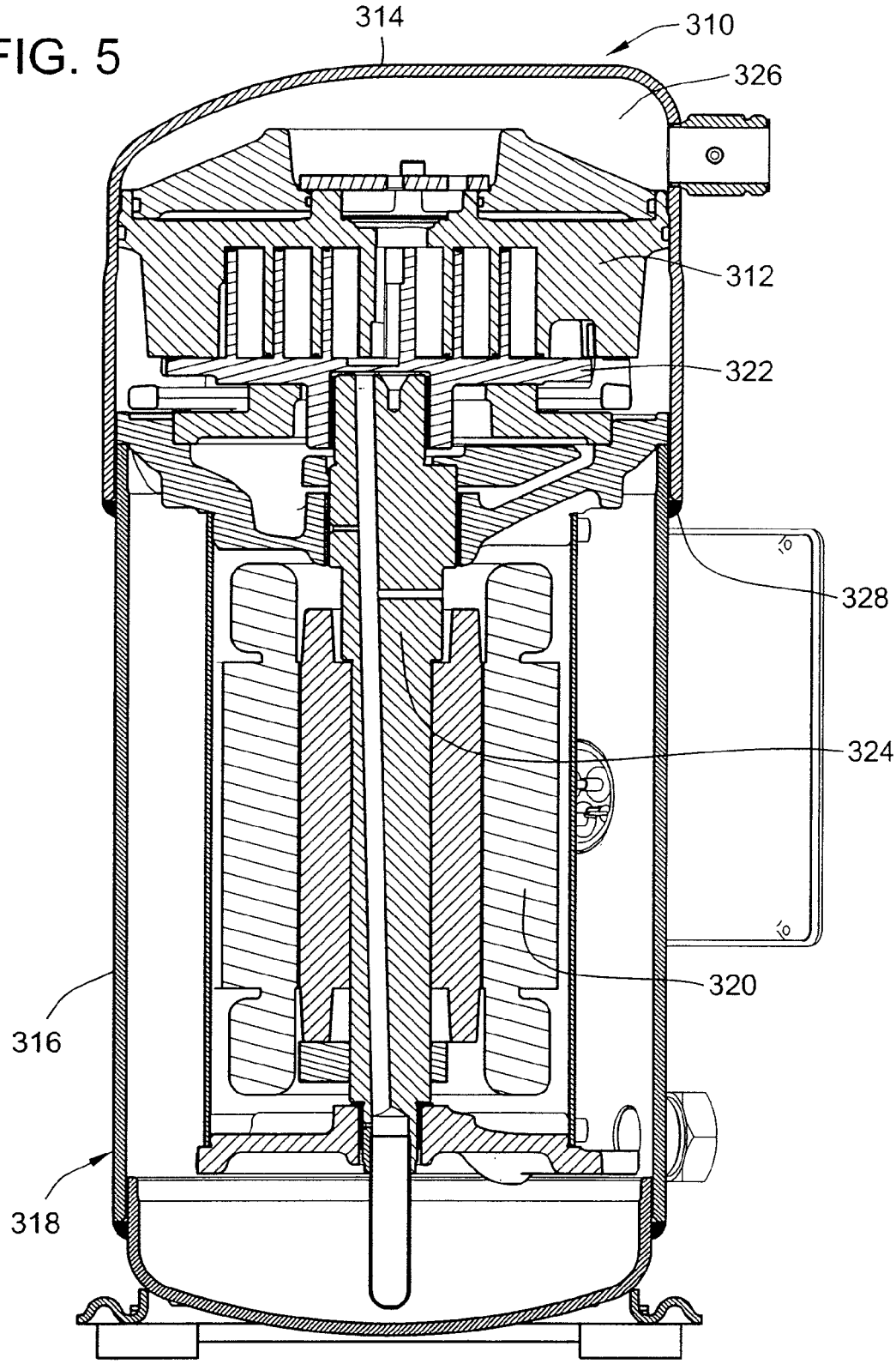
FIG. 5 is a cross section of a scroll compressor assembly in accordance with an alternative embodiment of the present invention.

An alternative embodiment of a scroll compressor assembly 310 is illustrated in FIG. 5-. This embodiment is much like the first embodiment except that additional configuration features between the fixed scroll compressor body 312 and the upper housing shell section 314 are provided that also locate the upper housing shell section 314 relative to the cylindrical wall of the intermediate housing shell section 316. As such, attention will be directed toward these differences. However, it should be pointed out that this embodiment similarly includes an outer housing 318 comprised of multiple shell sections that are telescopically interfitted; a drive unit in the form of an electrical motor 320; and a movable scroll compressor body 322 that is driven by the electrical motor 320 via drive shaft 324 to facilitate relative movement of the movable scroll compressor body 322 and the fixed scroll compressor body 312 to facilitate compression of refrigerant to the high pressure chamber 326.

In accordance with the present invention, in this embodiment the upper housing shell section 314 is located axially relative to a remainder of the housing off of the fixed scroll compressor body 312, which similarly provides a stop limit as in the first embodiment. Preferably, the upper housing shell section 314 will axially abut with the fixed scroll compressor body 312 as is more clearly illustrated in the enlarged views of FIGS. 6 and 7 that show cooperating step regions 332, 342 which axially abut. The upper housing shell section 314 telescopically interfits with the intermediate housing shell section 316 with axial abutment provided therebetween for accurately locating the two housing shell sections 314, 316 axially and thereby determining an axial location of a circumferential weld 328 that secures and hermetically seals between these two housing sections.

To provide for the aforementioned step regions 332, 342, the fixed scroll compressor body includes a generally cylindrical outer periphery 330 that is interrupted with the step region 332 to include a larger diameter section 334 and a smaller diameter section 336 with an axial abutment 338 joining these two sections 334, 336. Similarly, the generally cylindrical inner periphery 340 of the extending cylindrical wall region of the upper housing shell section 314 includes the step region 342 to include a larger diameter section 344 and a smaller diameter section 346 that are joined by a radially extending axial abutment 348 that joins and is generally defined between the larger and smaller diameter sections 344, 346 ("sections" may also be referred to as "regions" and are interchangeably used). The corresponding step regions 332 and 342 receive each other with the corresponding axial abutments 338, 348 in axial engagement and abutment so as to precisely locate the upper housing shell section 314 relative to the intermediate housing shell section 316 to thereby locate the circumferential weld 328 in a predetermined location and also determine a desired volume of the high pressure chamber 326. Preferably and as illustrated, this can be done without the need for additional fixtures or locating devices. Instead, the upper housing shell section 314 may be placed upon the remainder of the scroll compressor assembly to facilitate assembly, location and attachment.

As illustrated, an annular groove 350 is defined in the outer periphery 330 of the fixed scroll compressor body 312 with a ring seal 352 seated therein for sealing between the fixed scroll compressor body 312 and the upper housing shell section 314. To ensure appropriate sealing, and also to facilitate proper axial abutment, an annular clearance gap 354 is defined between the smaller diameter section 346 of the upper shell section and the smaller diameter section 336 of the fixed scroll compressor body (see e.g. FIGS. 6 and 7). Preferably, the groove 350 and the ring seal 352 are provided by the larger diameter section 334 in engagement with the upper housing larger diameter section 334, and below the abutments 338, 348 as shown.

Yet a further feature is that the corresponding abutment 338, 348 of the upper housing shell section in the fixed scroll compressor bodies provide mutually engaging cam surfaces for centering the fixed scroll compressor body relative to the shell section. This may be accomplished by making the axial abutment surfaces mutually arcuate 356 as illustrated in the figures.

Figure 7:
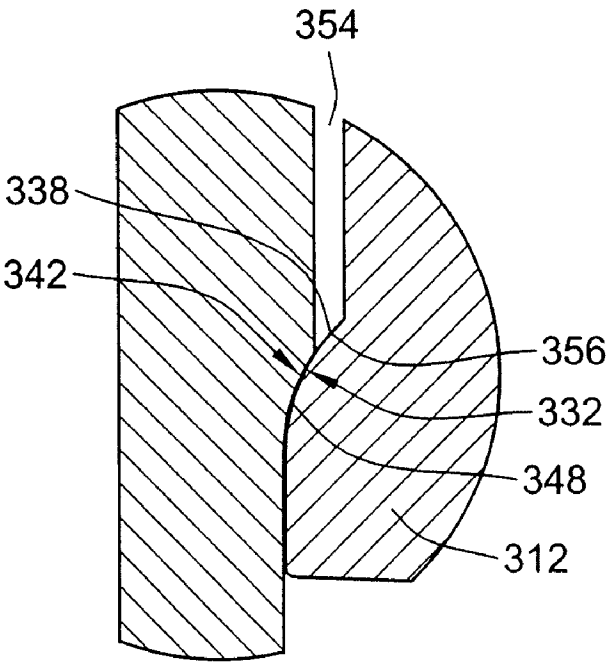
FIG. 7 is a further enlarged view of a portion of FIG. 6, to illustrate how the upper shell section may abut the fixed scroll member along a stepped region.
Figure 6:
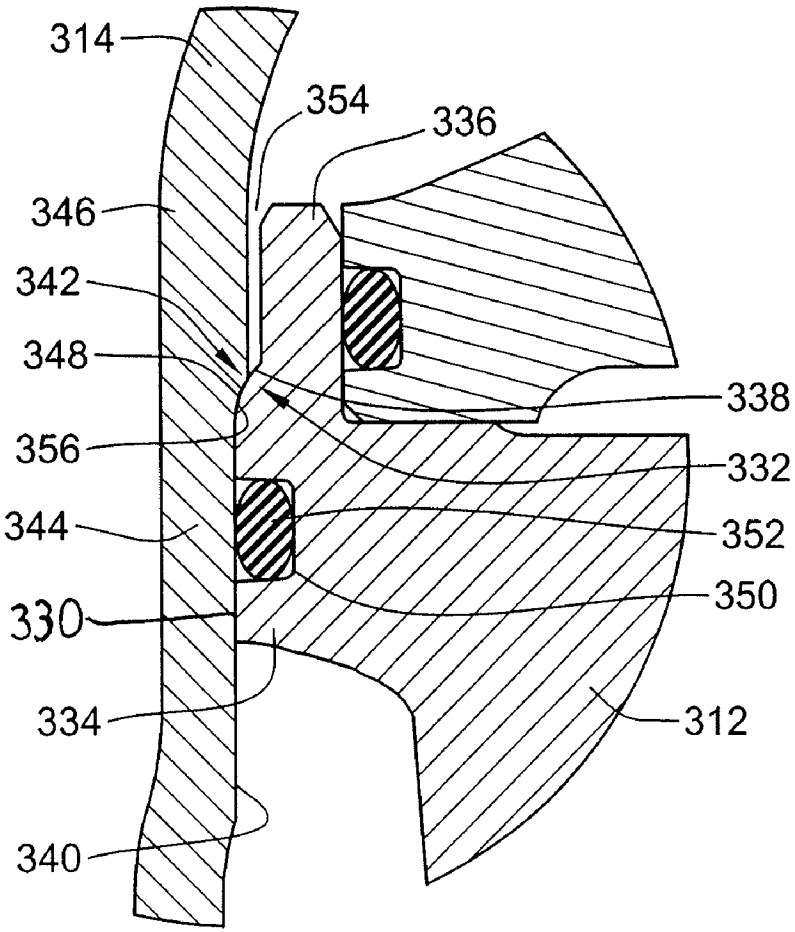
FIG. 6 is an enlarged view of a portion of FIG. 5 illustrating the interface between the upper shell section and the fixed scroll compressor body.

The upper housing shell section 314 is preferably formed from sheet metal material. To accommodate the different diameter regions 344, 346, the thickness of the sheet metal material may be modified to accommodate and form the step region 342 as illustrated in FIGS. 6 and 7. Specifically, stamp forming and additional optional machine finishing operations can make the larger diameter region 344 and the smaller diameter region 346 to thereby form the step region 342. Additionally, the step region 332 of the fixed scroll compressor body 312 can be machined at different axial locations for different models or scroll compressor designs so as to locate the upper shell section in different locations for different compressors as may be desired. For example, by machining the abutment 338 at a higher location, the upper shell section can be caused to be raised to a higher location.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A scroll compressor, comprising:

a housing including a shell section;

scroll compressor bodies having respective bases and respective scroll ribs that project from the respective bases and which mutually engage about an axis for compressing fluid;

a drive unit operative to facilitate relative movement between the scroll compressor bodies;

wherein the shell section is located at an axial location relative to a remainder of the housing via contact between an inner surface of the shell section and a radially peripheral surface of one of the scroll compressor bodies; and a seal sealing between said one of the scroll compressor bodies and the shell section, the seal axially between the drive unit and the said axial location, wherein the shell section axially abuts one of the scroll compressor bodies above the seal.

2. The scroll compressor of claim 1, wherein the scroll compressor body that locates the shell section is a fixed scroll compressor body that is fixed relative to the housing.

3. The scroll compressor of claim 2, wherein the shell section telescopically fits with an annular wall of a second shell section, further comprising a circumferential weld securing the shell section and the second shell section together, the fixed compressor body determining a location of the circumferential weld.

4. The scroll compressor of claim 2, wherein the fixed scroll compressor body includes a generally cylindrical outer periphery, further including a step formed along the generally cylindrical outer periphery to include a larger diameter section and smaller diameter section joined by a radially extending abutment, wherein the abutment is defined between the larger and smaller diameter sections, the abutment engaging the shell section.

5. The scroll compressor of claim 4, wherein the shell section includes a generally cylindrical inner periphery, further including a step formed along the generally cylindrical inner periphery to include a larger diameter region and a smaller diameter region joined by a radially extending abutment region, wherein the abutment region is defined between the larger and smaller diameter regions, the abutment and the abutment region mutually engaging.

6. The scroll compressor of claim 5, further comprising an annular clearance gap between the smaller diameter section and the smaller diameter region.

7. The scroll compressor of claim 6, further comprising an annular groove formed into the larger diameter section, and the seal including a ring seal retained in the annular groove, the ring seal sealing between the shell section and the fixed scroll compressor body.

8. The scroll compressor of claim 7, wherein the abutment and the abutment regions comprise mutually engaging cam surfaces therebetween for centering the fixed scroll compressor body relative to the shell section.

9. The scroll compressor of claim 8, wherein the cam surfaces are arcuate.

10. The scroll compressor of claim 2, wherein the shell section includes a generally cylindrical inner periphery, further including a step formed along the generally cylindrical inner periphery to include a larger diameter region and smaller diameter region joined by a radially extending abutment region, wherein the abutment region is defined between the larger and smaller diameter regions, wherein the abutment region engages the fixed scroll compressor body.

11. The scroll compressor of claim 10, wherein the shell section is formed from sheet steel, the sheet steel having a constant thickness in the unformed state, and wherein the smaller diameter region is thicker in cross section than the larger diameter region.

12. The scroll compressor of claim 1, wherein the shell section is the uppermost section of the housing.

13. A method of making a scroll compressor, comprising:

assembling scroll compressor bodies having respective bases and respective scroll ribs that project from the respective bases and which mutually engage about an axis for compressing fluid;

assembling a housing shell section over the scroll compressor bodies;

limiting axial movement of the housing shell section via contact between an inner surface of the housing shell section and a radially peripheral surface of one of the scroll compressor bodies;

securing the housing section to a remainder of a housing;

sealing the housing shell section with one of the scroll compressor bodies below said limiting.

14. The method of claim 13, further comprising:

abutting the housing shell section with said one of the scroll compressor bodies.

15. The method of claim 14, further comprising:

centering the housing shell section relative to said one of the scroll compressor bodies.

16. The method of claim 15, further comprising:

fixing said one of the scroll compressor bodies relative to the housing.

17. The method of claim 13, wherein said housing shell section is the uppermost housing shell section having an end cover portion and cylindrical sidewall portion and wherein the housing further includes a second shell section, further comprising:

telescopically interfitting the cylindrical sidewall portion of the uppermost housing shell section and the second shell section;

circumferentially welding the uppermost housing shell section with the second shell section.

18. The method of claim 13, further comprising forming a step region in at least one of the inner periphery of the housing shell section and an outer periphery of said one of the scroll compressor bodies to define a limit for said limiting.

19. The method of claim 18, further comprising forming a step region in both of the inner periphery of the housing shell section and an outer periphery of said one of the scroll compressor bodies and abutting the step regions axially.

20. A scroll compressor, comprising:

a housing including a shell section;

scroll compressor bodies, including a fixed scroll compressor body and a movable scroll compressor body, having respective bases and respective scroll ribs that project from the respective bases and which mutually engage about an axis for compressing fluid;

a drive unit operative to facilitate relative movement between the scroll compressor bodies;

wherein the shell section axially abuts the fixed scroll compressor body through a step region in the shell section, wherein the shell section includes a generally cylindrical inner periphery and the step region is formed along the generally cylindrical inner periphery to include a larger diameter region and a smaller diameter region joined by a radially extending abutment region, the abutment region being defined between the larger and smaller diameter regions, the step region being formed by the thinning of a wall thickness of the shell section.

21. The scroll compressor of claim 20, wherein the shell section telescopically fits with an annular wall of a second shell section, further comprising a circumferential weld securing the shell section and the second shell section together, the fixed compressor body determining a location of the circumferential weld.

22. The scroll compressor of claim 21, wherein the fixed scroll compressor body includes a generally cylindrical outer periphery, further including a step formed along the generally cylindrical outer periphery to include a larger diameter section and smaller diameter section joined by a radially extending abutment, wherein the abutment is defined between the larger and smaller diameter sections, the abutment engaging the shell section.

23. The scroll compressor of claim 22, further comprising an annular groove formed into the larger diameter section and a ring seal retained in the annular groove, whereby the ring seal is disposed axially between the abutment and the drive unit, the ring seal sealing between the shell section and the fixed scroll compressor body.

24. The scroll compressor of claim 23, further comprising an annular clearance gap between the smaller diameter section and the smaller diameter region.

25. The scroll compressor of claim 24, wherein the abutment and the abutment regions comprise mutually engaging cam surfaces therebetween for centering the fixed scroll compressor body relative to the shell section.

26. The scroll compressor of claim 20, wherein the shell section is an uppermost shell section formed from sheet steel, the sheet steel having a constant thickness in the unformed state, and wherein the smaller diameter region is thicker in cross section than the larger diameter region.

* * * * *